US008406640B2

(12) United States Patent
Fujisawa et al.

(10) Patent No.: US 8,406,640 B2
(45) Date of Patent: Mar. 26, 2013

(54) TONER CARTRIDGE AND CONTROL METHOD OF DISPLAYING THE RESIDUAL TONER QUANTITY IN THE SAME TONER CARTRIDGE

(75) Inventors: Toshiaki Fujisawa, Osaka (JP); Kenichi Nagata, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 211 days.

(21) Appl. No.: 12/769,881

(22) Filed: Apr. 29, 2010

(65) Prior Publication Data

US 2010/0303482 A1 Dec. 2, 2010

(30) Foreign Application Priority Data

May 27, 2009 (JP) ..... 2009-127776

(51) Int. Cl.
*G03G 15/08* (2006.01)

(52) U.S. Cl. ..... 399/27; 399/24; 399/258; 399/262

(58) Field of Classification Search ..... 399/24, 399/27, 258, 262
See application file for complete search history.

(56) References Cited

U.S. PATENT DOCUMENTS

| | | | | |
|---|---|---|---|---|
| 5,655,174 | A * | 8/1997 | Hirst | 399/27 |
| 6,690,896 | B2 | 2/2004 | Hanada et al. | |
| 6,792,223 | B2 * | 9/2004 | Kobayashi | 399/70 |
| 2002/0025173 | A1 * | 2/2002 | Isobe et al. | 399/12 |
| 2002/0085848 | A1 | 7/2002 | Hanada et al. | |
| 2006/0034628 | A1 * | 2/2006 | Chihara | 399/27 |
| 2006/0127108 | A1 * | 6/2006 | Okuyama et al. | 399/27 |
| 2006/0140650 | A1 * | 6/2006 | Yokote | 399/27 |
| 2009/0022506 | A1 * | 1/2009 | Aratake et al. | 399/27 |
| 2009/0129792 | A1 * | 5/2009 | Izumi et al. | 399/27 |

FOREIGN PATENT DOCUMENTS

| | | | |
|---|---|---|---|
| JP | 2001-022230 | A | 1/2001 |
| JP | 2002-258596 | A | 9/2002 |
| JP | 2002-341641 | A | 11/2002 |
| JP | 2004-053744 | A | 2/2004 |
| JP | 2007-057890 | A | 3/2007 |
| JP | 2008-224877 | A | 9/2008 |

* cited by examiner

*Primary Examiner* — David Gray
*Assistant Examiner* — Francis Gray
(74) *Attorney, Agent, or Firm* — Renner, Otto, Boisselle & Sklar, LLP

(57) ABSTRACT

A toner cartridge for an image forming apparatus includes: a toner container; a toner feed port for supplying toner to a developing device; a toner feeding blade structure for feeding the toner from the toner container to the developing device; and a recording chip for recording history information on the toner container. The toner container includes a toner feed motor for rotationally driving the toner feeding blade structure. The recording chip includes a supplied toner quantity totalizer for summing the amounts of toner supplied and a residual toner quantity display controller for displaying the residual toner quantity in the toner container on a display portion of the image forming apparatus.

3 Claims, 3 Drawing Sheets

TONER CARTRIDGE AND CONTROL METHOD OF DISPLAYING THE RESIDUAL TONER QUANTITY IN THE SAME TONER CARTRIDGE

This Nonprovisional application claims priority under 35 U.S.C. §119(a) on Patent Application No. 2009-127776 filed in Japan on 27 May 2009, the entire contents of which are hereby incorporated by reference.

BACKGROUND OF THE INVENTION (1) Field of the Invention

The present invention relates to a toner cartridge and a control method of displaying the residual toner quantity in the same toner cartridge, and in particular, relates to a toner cartridge that is detachably set to an image forming apparatus that operates based on electrophotography or electrostatic recording technology or the like, and a control method of displaying the residual toner quantity in the same toner cartridge.

(2) Description of the Prior Art

Conventionally, as image forming apparatuses using electrophotography or electrostatic recording technology, copiers, printers, facsimile machines, multi-functional machines and the like have been known. In these image forming apparatuses, image forming is performed by forming an electrostatic latent image on the photoreceptor (toner image bearer) surface, supplying toner to the photoreceptor from a developing device to develop the electrostatic latent image, transferring the toner image that has been formed on photoreceptor by development to recording paper and fixing the toner image onto the recording paper with heat under pressure by means of a fixing device.

Since in image forming apparatuses of this kind, toner is gradually consumed, it is necessary to supply the toner.

For this purpose, in a prior art example, a toner supplying system in which a toner cartridge that contains toner is removably attached on the top of a developing device so as to supply the toner from the toner cartridge to the developing device, has been adopted, and in another prior art example, a toner supplying system in which an intermediate hopper is provided on the top of a developing device and a toner cartridge is removably attached on the top of the intermediate hopper so as to make the toner fall from the toner cartridge to the hopper and then supply the toner from the hopper to the developing device, has been adopted.

Further, when the residual toner quantity in the toner cartridge is detected to be low by detecting the amount of toner remaining in the toner cartridge or by estimating the consumption of toner by counting the number of pixels, replacement of the toner cartridge is recommended to thereby prevent interruption of operation due to toner supply.

On the other hand, for maintenance of toner cartridges and process cartridges, for prevention against attachment of incompatible units and also for recycling measures, recently the cartridges are equipped with a recording medium such as a barcode, magnetic card, nonvolatile memory, i.e., EEPROM, and the like, in which information for the aforementioned measures are written.

For example, there is a disclosed prior art technology (see patent document 1: Japanese Patent Application Laid-open 2001-22230) in which a contactless IC tag as a recording medium is provided for a toner cartridge so as to enable information on the number of recycled times, life, etc. of the toner cartridge to be written therein or written information to be read out therefrom, to thereby manage the usage conditions of the toner cartridge and its peripherals.

Further, in the color image forming apparatuses which have been increasingly used on the market, at least three, i.e., cyan, magenta and yellow colors of toners are used for development. Accordingly, the process speed for color image forming is low compared to the case of monochrome image forming, so is the number of printouts per minute.

To deal with this, as a prior art technology, for example the controller of the image forming apparatus is adapted to perform an initial adjustment process for its magnetic permeability sensor, immediately after power activation, at the warm-up time that is performed every predetermined number of printouts, at the time of loading the developer and when an environmental change of temperature, humidity and the like has occurred. In this initial adjustment process, the controller measures both the sensor adjustment value Vc for the magnetic permeability sensor at the lowest process speed and the sensor adjustment value Vc at the highest process speed, and determines the relation expression (linear expression) that represents the correlation between the process speed and sensor adjustment value Vc, based on these two sets of process speed and sensor adjustment value Vc. That is, an image forming apparatus with the controller that calculates the sensor adjustment values Vc at other process speeds based on the aforementioned relation expression is disclosed (patent document 2: Japanese Patent Application Laid-open 2004-53744).

Because the toner cartridge is equipped with a contactless IC tag, the configuration in patent document 1 is advantageous in terms of being able to manage the number of recycled times, life and others on the toner cartridge side. However, the contactless type configuration may be affected by noise from other electric parts, possibly causing malfunction. Also, from the viewpoint of cost performance, contact type recording media have been adopted under the existing circumstances.

Further, since, in patent document 2, the toner concentration of the developer is controlled based on the detection level of the detecting device (i.e., the magnetic permeability of the developer), it is possible to attain stable toner concentration control. However, there is no description as to the rotational rate of the drive motor, hence there may occur a case where toner supply cannot be correctly achieved. As a result, the residual toner quantity in the toner cartridge is misestimated, causing a fear that the toner cartridge is replaced by a new one even though the current toner cartridge has toner left therein.

Further, since it is demanded, in recent years, for the image forming apparatus to have a simple configuration and still achieve the full-color imaging function, the rotational drive force of a single motor is used to execute toner supply by means of gears, belts, etc., instead of using a dedicated toner supply motor for each developing device. This shared use of parts entails with the problem that proper toner supply in conformity with each of the developing devices cannot be carried out.

SUMMARY OF THE INVENTION

The present invention has been devised in view of the above conventional problems, it is therefore an object of the present invention to provide a toner cartridge for use in an image forming apparatus having different process speeds, which can estimate the correct amount of supplied toner, check and grasp the amount of toner left in the toner cartridge as well as providing a control method of displaying the residual toner quantity in the toner cartridge.

The toner cartridge and the control method of displaying the residual toner quantity in the toner cartridge according to the present invention to solve the above problems, can be presented as follows:

The first aspect of the present invention is a toner cartridge that is configured to be removably attached to an image forming apparatus, comprising: a toner container holding toner; a toner feed port for supplying the toner from the toner container to the image forming apparatus; a toner feeding member that is rotationally driven to supply the toner from the toner container to the image forming apparatus; and, a recording module (e.g., IC chip) for recording history information on the toner container, and is characterized in that the toner container includes a toner feed motor for rotationally driving the toner feeding member; the recording module includes a recording portion for recording the history information, a supplied toner quantity totalizer for summing the amounts of toner supplied from the toner feed port, and a residual toner quantity display controller for displaying the residual toner quantity in the toner container on a display portion of the image forming apparatus; the recording portion records the initial amount of toner stored in the toner container and a coefficient for the speed of a particular process relative to the predetermined speed of the standard process of the image forming apparatus; the supplied toner quantity totalizer has a function of adding up the product of the coefficient multiplied by the drive time of the toner feed motor in supplying toner; and, the residual toner quantity display controller has a function of calculating the amount of toner remaining in the toner container based on the summation of the products between the coefficient and the drive time, and a function of displaying the residual toner quantity on the display portion of the image forming apparatus.

According to the second aspect of the present invention, it is preferable that the recording module can be reused by resetting the history information as to the toner container.

The third aspect of the present invention is a control method of displaying the residual toner quantity in a toner cartridge used for an image forming apparatus and is characterized in that the toner cartridge includes: a toner container holding a toner; a toner feed port for supplying the toner from the toner container to the image forming apparatus; a toner feeding member that is rotationally driven to supply the toner from the toner container to the image forming apparatus; and, a recording module (e.g., IC chip) for recording history information on the toner container. The method comprising the steps of: rotationally driving a toner feed motor provided in the toner container in supplying toner from the toner cartridge to the image forming apparatus; adding up the product of the coefficient for the speed of a particular process relative to the predetermined speed of the standard process of the image forming apparatus, multiplied by the drive time of the toner feed motor in supplying toner; calculating the amount of toner remaining in the toner container based on the summation of the products between the coefficient and the drive time; and, displaying the residual toner quantity in the toner container on a display portion of the image forming apparatus.

According to the first aspect of the present invention, since the amount of toner supplied at each process speed can be determined easily, it is possible to exactly determine the amount of toner supplied at any process speed. Further, since the residual toner quantity in the toner container is displayed on the display portion of the image forming apparatus, it is possible to exactly confirm the residual toner quantity. As a result, it is possible to supply the toner appropriately for each of the individual developing devices. Further, since it is possible to exactly grasp the residual toner quantity in the toner container of the toner cartridge corresponding to each developing device, it is possible to realize stable image output by eliminating the event of a toner cartridge being replaced with a new toner cartridge before the toner in the toner container is used up and the risk of the toner being used up in the course of a job.

Also, according to the second aspect of the present invention, since the recording module can be reused by resetting the history information as to the toner container, it is possible to deal with variation of the amount of supplied toner depending on individual toner cartridges.

Finally, according to the third aspect of the present invention, since the amount of toner supplied at each process speed can be determined easily, it is possible to exactly determine the amount of toner supplied at any process speed. Further, since the residual toner quantity in the toner container is displayed on the display portion of the image forming apparatus, it is possible to exactly confirm the residual toner quantity. As a result, it is possible to supply the toner appropriately for each of the individual developing devices. Further, since it is possible to exactly grasp the residual toner quantity in the toner container of the toner cartridge corresponding to each developing device, it is possible to realize stable image output by eliminating the event of a toner cartridge being replaced with a new toner cartridge before the toner in the toner container is used up and the risk of the toner being used up in the course of a job.

DESCRIPTION OF THE PREFERRED EMBODIMENTS

The mode for carrying out the present invention will be described with reference to the drawings.

Figure 1:
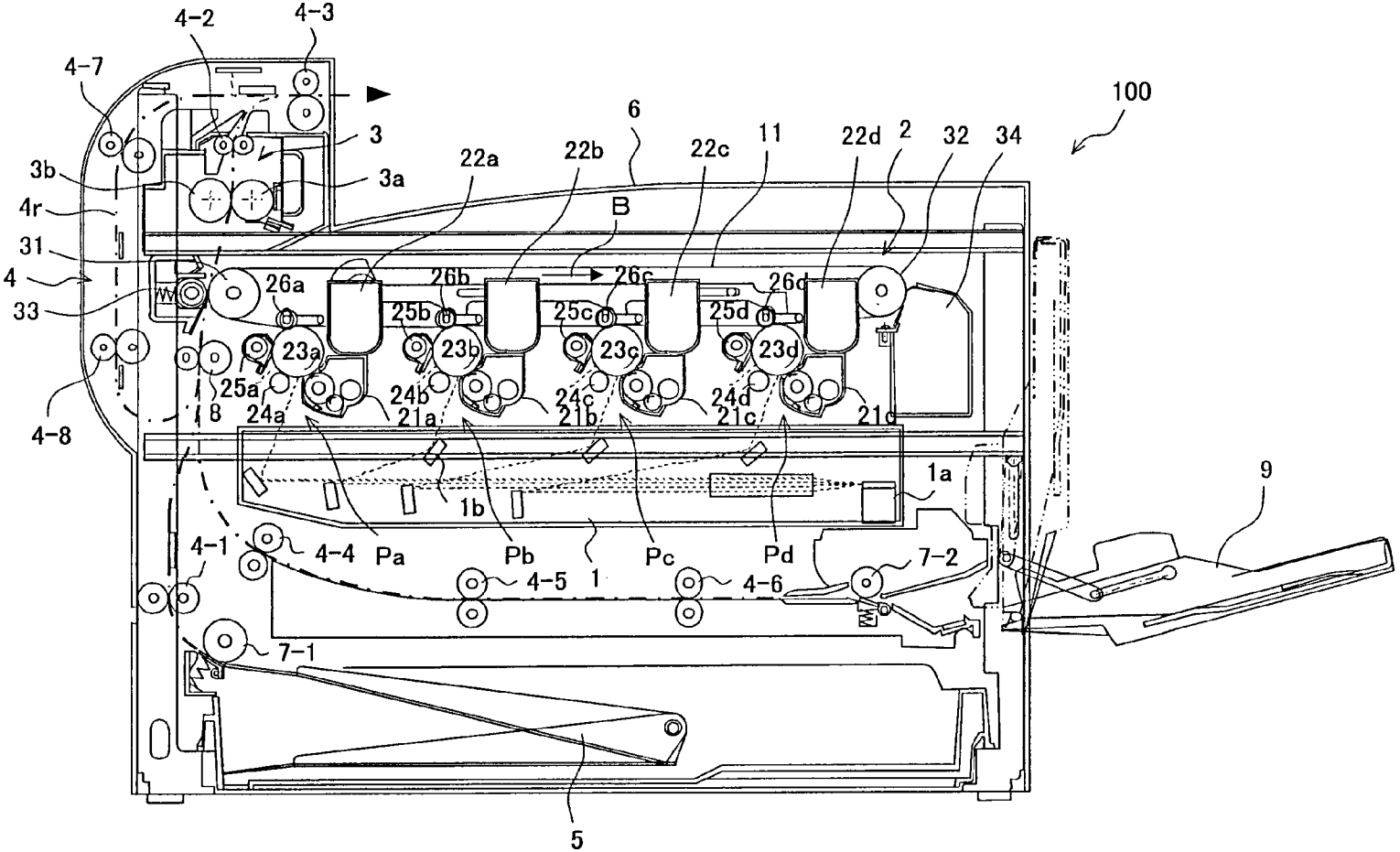
FIG. 1 is an illustrative view showing an overall configuration of an image forming apparatus using a toner cartridge according to the embodiment of the present invention.

FIG. 1 shows one exemplary embodiment for carrying out the present invention, and is an illustrative view showing an overall configuration of an image forming apparatus using a toner cartridge according to the embodiment of the present invention.

An image forming apparatus 100 of the present embodiment forms an image with toners based on electrophotography, including: as shown in FIG. 1, photoreceptor drums 23*a*, 23*b*, 23*c* and 23*d* (which may be also called "photoreceptor drums 23" when general mention is made) for forming electrostatic latent images on the surface thereof; chargers (charging devices) 24*a*, 24*b*, 24*c* and 24*d* (which may be also called "chargers 24" when general mention is made) for charging the surfaces of photoreceptor drums 23; an exposure unit 1 for forming electrostatic latent images on the photoreceptor drum 23 surfaces; developing devices 21*a*, 21*b*, 21*c* and 21*d*

(which may be also called "developing devices 21" when general mention is made) for supplying toners to the electrostatic latent images on the photoreceptor drum 23 surfaces to form toner images; toner cartridges 22*a*, 22*b*, 22*c* and 22*d* (which may be also called "toner cartridges 22" when general mention is made) that are removably attached to respective developing devices 21 to supply toners to the developing devices 21; an intermediate transfer belt unit 2 for transferring the toner images from the photoreceptor drum 23 surfaces to a recording medium; and a fixing unit (fixing device) 3 for fixing the toner image to the recording medium.

To begin with the overall configuration of image forming apparatus 100 will be described.

As shown in FIG. 1, image forming apparatus 100 is a color laser printer for recording color images on recording paper, and includes exposure unit 1, image forming stations Pa, Pb, Pc and Pd, intermediate transfer belt unit 2, fixing unit 3, a paper conveyor system 4, a paper feed tray, a paper output tray 6 and others.

In this image forming apparatus 100, the recording paper is stacked on paper feed tray 5 and is drawn out from paper feed tray 5, sheet by sheet, by a pickup roller 7-1 and conveyed to a registration roller 8 by a feed roller 4-1. Recording paper may also be placed on a manual feed tray 9, and may be drawn out therefrom by a pickup roller 7-2 and conveyed by feed rollers 4-4 to 4-6 to registration roller 8.

Registration roller 8 temporarily suspends the recording paper to register the leading end of the recording paper and then delivers the recording paper to a secondary transfer roller 12 at such timing that the leading end of the image forming area of the recording paper meets the leading end of the toner image formed on intermediate transfer belt 11 of intermediate transfer belt unit 2.

The image forming stations Pa, Pb, Pc and Pd form toner images of black (K), cyan (C), magenta (M) and yellow (Y) colors, respectively, and transfer toner images of each color to intermediate transfer belt 11 of intermediate transfer belt unit 2.

These image forming stations Pa, Pb, Pc and Pd each include developing device 21*a*-21*d*, toner cartridge 22*a*-22*d*, photoreceptor drum 23*a*-23*d*, charger 24*a*-24*d*, cleaner unit 25*a*-25*d* and others.

The photoreceptor drums 23*a* to 23*d* are pressed against primary transfer rollers 26*a* to 26*d*, respectively, with intermediate transfer belt 11 held therebetween and rotated at the same peripheral speed with that of intermediate transfer belt 11 that circulates in the direction of arrow B. Each of primary transfer rollers 26*a* to 26*d* also rotates following intermediate transfer belt 11 at the same peripheral speed with that of intermediate transfer belt 11 that circulates in the direction of arrow B.

Each charger 24*a*-24*d* is a component that uniformly electrifies the surface of corresponding photoreceptor drum 23*a*-23*d* and may use a roller or brush type that is put in contact with photoreceptor drum 23*a*-23*d*, or may use a discharger type.

Cleaner unit 25*a*-25*d* removes and collects the toner remaining on the photoreceptor drum 23*a*-23*d* surface after development and image transfer stages.

Exposure unit 1 includes a laser light source 1*a* and a plurality of mirrors 1*b*.

Laser light source 1*a* emits a laser beam to each of photoreceptor drums 23*a* to 23*d*. The multiple mirrors 1*b* guide the laser beams to respective photoreceptor drums 23*a* to 23*d*.

This exposure unit 1 modulates each laser beam in accordance with image data and irradiates the surfaces of photoreceptor drums 23*a* to 23*d* with associated laser beams so as to form electrostatic latent images on the surfaces of photoreceptor drums 23*a* to 23*d*, respectively.

Here, writing heads including an array of light emitting elements such as EL (electroluminescence), LEDs, etc., may be also used as exposure unit 1.

Toner cartridges 22*a* to 22*d* hold black (K), cyan (C), magenta (M) and yellow (Y) toners, respectively. Developing devices 21*a* to 21*d* are supplied with the toner of the corresponding color from respective toner cartridges 22*a* to 22*d* and adhere the toner of the corresponding color to the electrostatic latent images on the surface of photoreceptor drums 23*a* to 23*d*. These toner images are transferred from photoreceptor drums 23*a* to 23*d* and laid one over the other on intermediate transfer belt 11.

Intermediate transfer belt unit 2 includes intermediate transfer belt 11, primary transfer rollers 26*a* to 26*d*, a drive support roller 31, a driven support roller 32, a secondary transfer roller 33 and others, and supports intermediate transfer belt 11 that is wound between drive support roller 31 and driven support roller 32 in a circulatively movable manner while each of primary transfer rollers 26*a* to 26*d* and secondary transfer roller 33 are put in pressing contact with intermediate transfer belt 11.

Intermediate transfer belt 11 is formed of a synthetic resin film of about 100 to 150 μm thick, for instance. Secondary transfer roller 33 is supported so as to be movable left and right in the drawing, and holds intermediate transfer belt 11 with drive support roller 31 when the roller 33 is moved to the right, forming a nip region.

While functioning a role as a backup roller for secondary transfer roller 33, drive support roller 31 is rotationally driven so as to circulatively pull or move intermediate transfer belt 11 in the direction of arrow B through the nip regions that are located upstream of the roller 33 with respect to the belt moving direction and formed between primary transfer rollers 26*a* to 26*d* and photoreceptor drums 23*a* to 23*d*. In this arrangement, each nip region can be stably formed.

Here, in order to create the nip region between each primary transfer roller 26*a*-26*d* and photoreceptor drum 23*a*-23*d* in a more stable manner, it is preferable that either primary transfer roller 26*a*-26*d* or photoreceptor drum 23*a*-23*d* is formed of a hard material while the other is formed of an elastic material.

Each primary transfer roller 26*a*-26*d* is composed of, for example a metal shaft having a diameter of 8 mm to 10 mm and a conductive elastic material (e.g., EPDM, foamed urethane, etc.,) coated on the peripheral surface of the shaft. When intermediate transfer belt 11 is held at the nip regions between each of primary transfer rollers 26*a* to 26*d* and each of photoreceptor drums 23*a* to 23, each primary transfer roller 26*a*-26*d* is applied with a bias voltage of a polarity (+) opposite to the polarity (−) of the electrostatic charge on the toner so as to generate an electric field acting on the toner on the surface of photoreceptor drum 23*a*-23*d* beyond intermediate transfer belt 11, whereby the toner on the surface of photoreceptor drum 23*a*-23*d* is attracted and transferred to intermediate transfer belt 11. With this process, the toner images of individual colors are transferred to intermediate transfer belt 11 with one image laid over the other.

Here, transfer brushes or the like may also be used instead of primary transfer rollers 26*a* to 26*d*.

A cleaning unit 34 is, for example, a cleaning blade that is put in sliding contact with the intermediate transfer belt 11 surface to remove the toner remaining on the intermediate transfer belt 11 surface to prevent fogging and other defects in the image to be printed at a next operation. The area of intermediate transfer belt 11 in contact with intermediate transfer belt 11 is backed up from the interior side by driven support roller 32.

The laminated toner images of colors thus transferred on intermediate transfer belt 11 are conveyed to the nip region between drive support roller 31 and secondary transfer roller 33 as the intermediate transfer belt 11 circulatively moves. Then, the color toner images that have been laminated, one over the other, on intermediate transfer belt 11, are superposed on the recording paper that is being conveyed from registration roller so that the leading end of the toner images meets the leading end of the image forming area of the recording paper, and transferred to the recording paper.

Subsequently, the recording paper is conveyed to fixing unit 3, where the paper is pressed between a pressing roller 3*a* and heat roller 3*b*. As a result, the toners of different colors on the recording paper are fused and mixed with heat so that the toner images of individual colors are fixed as a full-color image on the recording paper. Then, the recording paper is conveyed by paper conveyor system 4 and discharged face-down onto paper output tray 6.

Here, it is possible to form a monochrome image using image forming station Pa alone and transfer the monochrome image to intermediate transfer belt 11 of intermediate transfer belt unit 2. That is, this monochrome image is also transferred from intermediate transfer belt 11 to the recording paper and then fixed to the recording paper, in the same manner as a full-color image.

Further, when dual-sided printing is performed instead of one-sided printing for the obverse side of recording paper only, the image on the obverse side of recording paper is fixed by fixing unit 3, then the recording paper is conveyed by a feed roller 4-3 of paper conveyor system 4. The feed roller 4-3 is stopped in the halfway the recording paper is conveyed, and then driven in reverse so that the recording paper is guided and conveyed through an reversing path 4*r* of the paper conveyor system 4 so as to be turned over, and led once again to registration roller 8. Thereafter, an image is recorded on the rear side of the recording paper and fixed thereto, and the recording paper is then discharged to paper output tray 6.

In the present embodiment, image forming apparatus 100 has two levels of process speed, specifically, 240 mm/sec for monochrome image forming and 120 mm/sec for color image forming.

Next, the configuration of toner cartridges 22*a* to 22*d* that characterizes the present embodiment will be described in detail with reference to the drawings.

Figure 2:
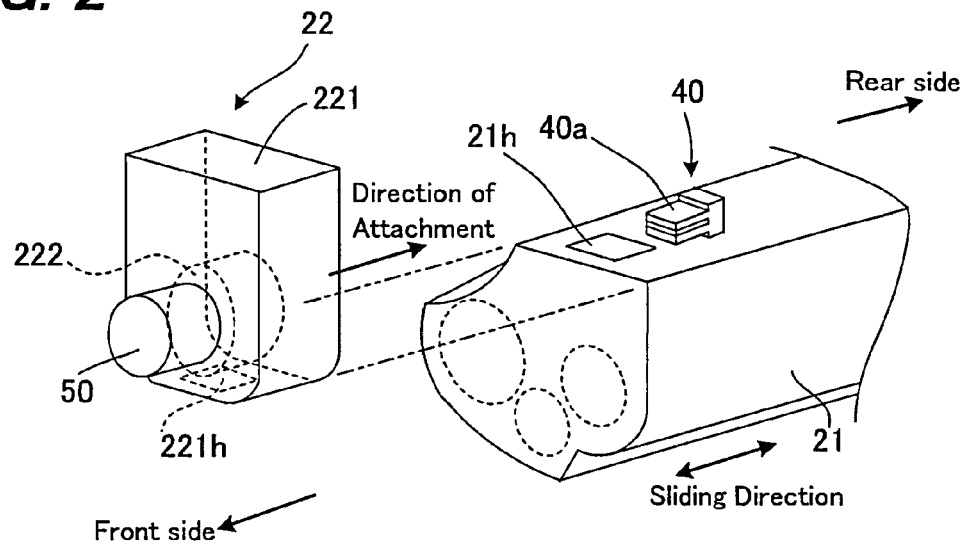
FIG. 2 is a schematic perspective view showing the toner cartridge before its attachment to a developing device when viewed from the front side.
Figure 3:
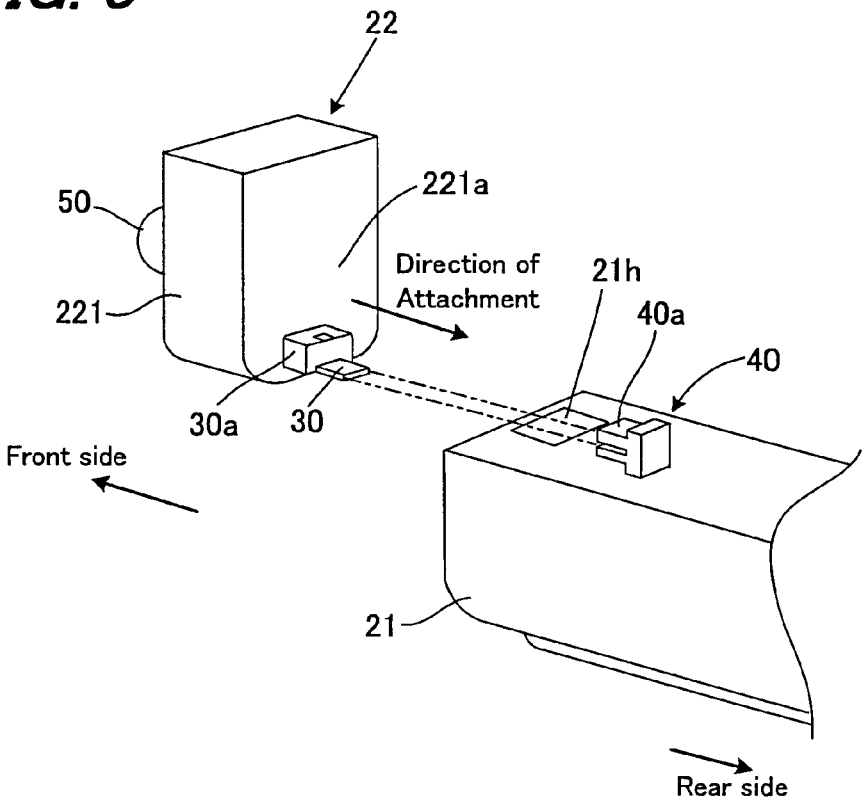
FIG. 3 is a schematic perspective view showing the toner cartridge before its attachment to a developing device when viewed from the rear side.
Figure 4:
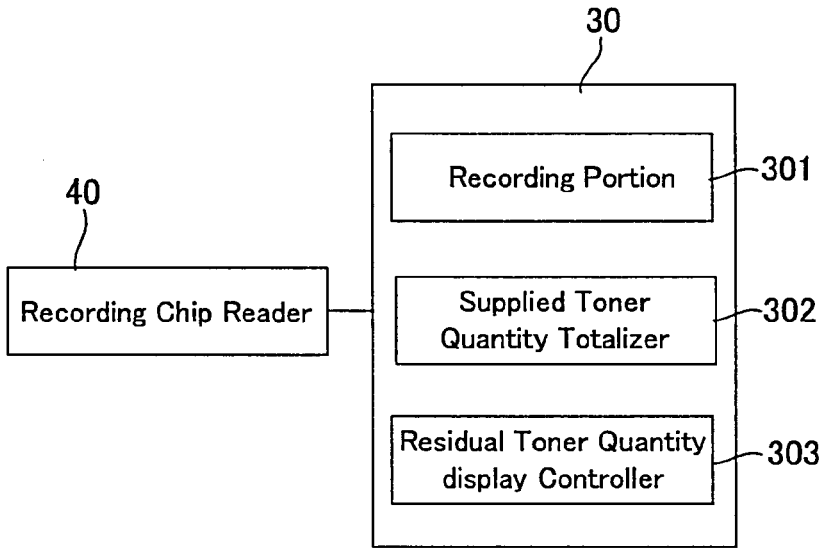
FIG. 4 is a block diagram showing a configuration of a recording chip as a part of the toner cartridge; and, FIG. 5 is a graph showing one example of how the amount of toner to be supplied evolves depending on the process speed in the developing device of the present embodiment.

FIG. 2 is a schematic perspective view showing a toner cartridge of the present embodiment before its attachment to the developing device when viewed from the front side. FIG. 3 is a schematic perspective view showing the toner cartridge before its attachment to the developing device when viewed from the rear side. FIG. 4 is a block diagram showing a configuration of a recording chip as a part of the toner cartridge.

As shown in FIGS. 2 and 3, toner cartridge 22 of the present embodiment is configured to be removably attached to developing device 21, and includes: a box-shaped toner container 221 for storing toner; a toner feed port 221*h* for feeding toner from toner container 221 to developing device 21; a toner feeding blade structure (toner feeding member) 222 that rotates to feed the toner from toner container 221 to developing device 21; a recording chip (recording module) 30 for recording history information as to toner container 221; and a toner feed motor 50 that rotates and drives toner feeding blade structure 222.

As shown in FIG. 2, toner feed port 221*h* is disposed at the bottom of toner container 221 so that the port is aligned with a toner inlet port 21*h* that is provided on the top of developing device 21 when toner cartridge 22 is set in developing device 21.

Further, toner cartridge 22 is configured so as to feed toner to the developing device 21 side by rotationally driving toner feeding blade structure 222 inside toner container 221 by means of toner feed motor 50.

Here, toner cartridge 22 is constructed to be able to feed toner to developing device 21 when toner feed port 221*h* and toner inlet port 21*h* coincide with each other. However, the configurations of the shutters and the like in developing device 21 and toner cartridge 22 which are naturally needed to open and close toner feed port 221*h* and toner inlet port 21*h*, are omitted in the drawing.

Toner feeding blade structure 222 is configured of a screw auger having a helical blade for example, and supplies a predetermined amount of toner to the developing device 21 side in conformity with the rotational rate.

Here, the configuration of toner feeding blade structure 222 should not be particularly limited to the above configuration as long as it can supply a predetermined amount of toner to the developing device 21 side in conformity with the rotational rate of toner feeding blade structure 222.

Recording chip 30 uses an IC chip, is removably attached to a chip holder 30*a* provided on the rear side 221*a* of toner container 221 as shown in FIG. 3, and is inserted in a reading portion 40*a* of a recording chip reader 40 arranged on the top of developing device 21 when toner cartridge 22 is set in developing device 21.

As shown in FIG. 4, recording chip 30 includes a recording portion 301, a supplied toner quantity totalizer 302 and a residual toner quantity display controller 303.

Recording portion 301 is recorded with the amount of supplied toner (amount of use) that has been supplied from toner container 221 to developing device 21, and other history information on toner container 221 such as the product number, ID number, toner color, initial toner quantity, coefficients for the speeds of particular processes relative to the predetermined speed of the standard process of image forming apparatus 100, and the like. Here, recording chip 30 is adapted to be reusable by resetting the history information as to the aforementioned toner container 221.

Further, recording chip 30 includes supplied toner quantity totalizer 302 for summing the amount of toner supplied from toner feed port 221*h* and residual toner quantity display controller 303 for displaying the residual toner quantity in toner container 221 on an unillustrated display portion of image forming apparatus 100.

Supplied toner quantity totalizer 302 has the function of summing the amounts of toner supplied from toner feed port 221. Specifically, the totalizer adds up the product of the coefficient for the speed of a particular process relative to the predetermined speed of the standard process of image forming apparatus 100, multiplied by the operation time of toner feed motor 50 in supplying toner to developing device 21.

Residual toner quantity display controller 303 displays the residual toner quantity in toner container 221 that is calculated based on the total amount of toner supplied to developing device 21 calculated by supplied toner quantity totalizer 302, on the unillustrated display portion or the like of image forming apparatus 100.

Recording chip reader 40 can read the information recorded on recording chip 30 when recording chip 30 has been inserted in the slot of reading portion 40*a*.

When toner cartridge 22 is set in developing device 21, recording chip 30 attached to toner cartridge 22 is inserted into the slot of reader 40*a* of recording chip reader 40 attached to developing device 21.

Toner feed motor 50 is controlled so as to rotate for a constant period of time, based on the signal from a toner concentration sensor (not shown) provided for developing device 21. The total operating time of the toner feed motor 50 and the process speed at that operation are recorded into recording chip 30.

Now, the recording method of recording chip 30 in toner cartridge 22 of the present embodiment will be described.

Figure 5:
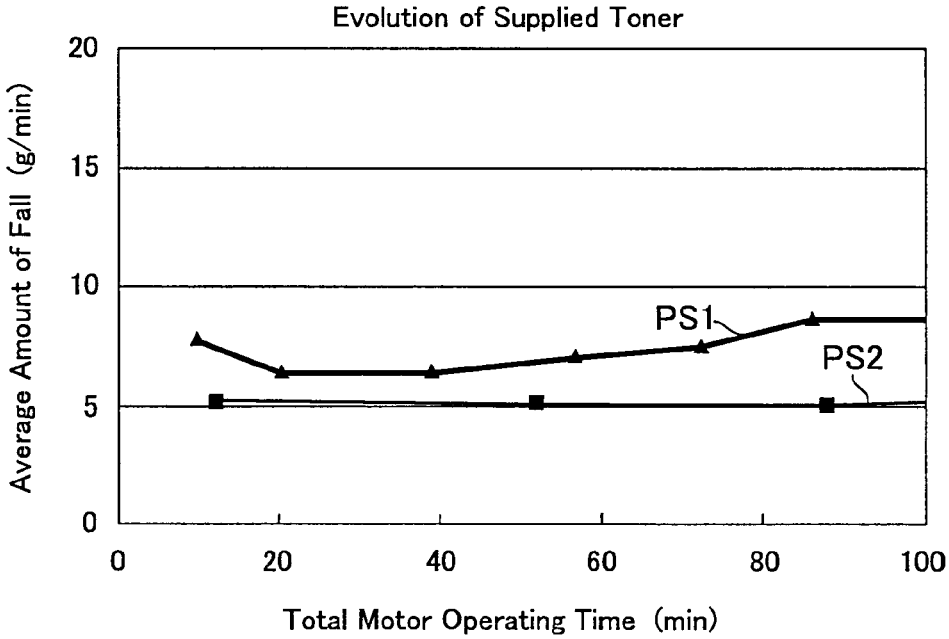

FIG. 5 is a graph showing one example of how the amount of toner to be supplied evolves depending on the process speed in the developing device of the present embodiment.

First, in the conventional recording chip, the periods of time in which the toner feed motor is actually operated are summed up, and this total time is adopted for evaluation. For example, when in the image forming apparatus, the time of an operation at a process speed of 240 mm/sec is represented as T1 and the time of an operation at a process speed of 120 mm/sec is represented as T2, the total operation time of the motor for these process speeds is given as ΣT1+ΣT2.

Then, the amount of toner that has been supplied to the developing device is calculated based on this total operation time of the motor.

In reality, however, it is impossible to exactly estimate the amount of supplied toner based on the operation time of the toner feed motor alone. That is, even if the motor is operated for a certain period, different amounts of toner are supplied or fall depending on the mode, that is, the amount of supplied toner results in being different between the mode having a process speed of 240 mm/sec and the mode having a process speed of 120 mm/sec, as shown in FIG. 5.

More specifically, when the amount of toner supplied per minute at the high process speed (i.e., 240 mm/sec) is assumed to be 1, the amount of toner per minute at the low process speed (i.e., 120 mm/sec) is evaluated to be about 0.7. Here, in FIG. 5, the vertical axis represents the average amount of toner fall (g/min) during the operation time of the motor represented by the horizontal axis. As the average amount of toner fall at each process speed that is further averaged with respect to the operation time of the motor, 7.41 g/min for a process speed of 240 mm/sec and 5.17 g/min for a process speed of 120 mm/sec are obtained.

Accordingly, when toner is supplied to the developing device in the conventional image forming apparatus, if the image forming apparatus has been operated some times at the high process speed and the other times at the low process speed, there occurs an event that an indication that instructs the user to replace the toner cartridge with a new one is given even though toner still remains in the current toner cartridge. It should be added that this conventional problem can also be considered to occur in relation with the fluidity of the toner.

To deal with, in consideration of the difference in the quantity of supplied toner depending on the process speed, the recording chip 30 of the present embodiment is provided with supplied toner quantity totalizer 302, and makes estimation by summing up the product of the operation time of toner feed motor 50 multiplied by 1 as the coefficient for the amount of supplied toner when the image forming apparatus 100 is operated at the standard process time, i.e., 240 mm/sec, and the product of the operation time multiplied by 0.7 as the coefficient for the process speed of 120 mm/sec. Here, the coefficients may be determined on an experiment basis or the like.

That is, supplied toner quantity totalizer 302 records the summation (ΣT1+ΣT2×0.7), that is, the sum of the total time ΣT1×1 (coefficient) of the operation at the process speed of 240 mm/sec and the total time ΣT2×0.7 (coefficient) of the operation at the process speed of 120 mm/sec.

Accordingly, the residual toner quantity T in toner cartridge 22 can be given as $$T0-(\Sigma T1+\Sigma T2\times 0.7)\times(\text{the amount of supplied toner per unit time}),$$

where T0 is the initial amount of toner.

Then, recording chip 30 causes residual toner quantity display controller 303 to display the residual toner quantity T on the control panel (display portion) of image forming apparatus 100 so as to inform the user of the condition of the remaining toner in toner cartridge 22.

According to the present embodiment configured as described above, since, in toner cartridge 22 of image forming apparatus 100, toner container 221 is equipped with recording chip 30 including recording portion 301, supplied toner quantity totalizer 302 and residual toner quantity display controller 303, and toner feed motor 50 for rotationally driving toner feeding blade structure 222, it is possible to exactly estimate the quantity of toner supplied to developing device 21 even if image forming is carried out at plural different process speeds. As a result, it is possible to exactly calculate the quantity of toner remaining in toner cartridge 22. Further, displaying of the residual toner quantity on the control panel (display portion) of image forming apparatus 100 makes it possible to readily inform the user of the condition of the remaining toner in toner cartridge 22.

Though the above embodiment was described taking the example in which toner cartridge 22 of the present invention is applied to the image forming apparatus 100 shown in FIG. 1, as long as it is an image forming apparatus in which toner is supplied to the developing device using a toner cartridge, the invention can be developed to any other image forming apparatus and the like, not limited to the image forming apparatus and copier described above.

For example, the present invention can also be applied to a configuration having three levels of process speeds, or a configuration in which toner is supplied by making use of the drive force from the developer, instead of using a toner motor dedicated for the toner cartridge.

Having described heretofore, the present invention is not limited to the above embodiment, various changes can be made within the scope of the appended claims. That is, any embodied mode obtained by combination of technical means modified as appropriate without departing from the spirit and scope of the present invention should be included in the technical art of the present invention.

What is claimed is:

1. A toner cartridge that is configured to be removably attached to an image forming apparatus having at least two different process speeds, comprising:

a toner container holding toner;

a toner feed port for supplying the toner from the toner container to the image forming apparatus;

a toner feeding member that is rotationally driven to supply the toner from the toner container to the image forming apparatus; and a recording module for recording history information on the toner container, wherein the toner container includes a toner feed motor for rotationally driving the toner feeding member;

the recording module includes a recording portion for recording the history information, a supplied toner quantity totalizer for summing amounts of toner supplied from the toner feed port, and a residual toner quantity display controller for displaying the residual toner quantity in the toner container on a display portion of the image forming apparatus;

the recording portion records an initial amount of toner stored in the toner container and a coefficient for each of the at least two different process speeds relative to a predetermined standard process speed of the image forming apparatus;

the supplied toner quantity totalizer sums the amounts of toner supplied from the toner feed port by adding up, for each of the at least two different process speeds, products of the coefficient for the process speed multiplied by a drive time of the toner feed motor in supplying toner at the process speed; and, the residual toner quantity display controller calculates an amount of toner remaining in the toner container based on the summation of the products between the coefficients and the drive times, and displays the residual toner quantity on the display portion of the image forming apparatus.

2. The toner cartridge according to claim 1, wherein the recording module can be reused by resetting the history information as to the toner container.

3. A control method of displaying residual toner quantity in a toner cartridge used for an image forming apparatus having at least two different process speeds, wherein the toner cartridge includes:

a toner container holding a toner;

a toner feed port for supplying the toner from the toner container to the image forming apparatus;

a toner feeding member that is rotationally driven to supply the toner from the toner container to the image forming apparatus; and a recording module for recording history information on the toner container, the method comprising the steps of:

rotationally driving a toner feed motor provided in the toner container in supplying toner from the toner cartridge to the image forming apparatus;

summing the amounts of toner supplied from the toner feed port by adding up, for each of the at least two different process speeds, products of a coefficient for process speed for a particular process relative to a predetermined standard process speed of the image forming apparatus, multiplied by a drive time of the toner feed motor in supplying toner at the process speed;

calculating an amount of toner remaining in the toner container based on the summation of the products between the coefficients and the drive times; and, displaying the residual toner quantity in the toner container on a display portion of the image forming apparatus.

* * * * *